US012467321B1

(12) United States Patent
Fripp et al.

(10) Patent No.: US 12,467,321 B1
(45) Date of Patent: Nov. 11, 2025

(54) FAIRINGS FOR MOBILE DOWNHOLE TOOLS IN PRODUCING WELLS

(71) Applicant: Halliburton Energy Services, Inc., Houston, TX (US)

(72) Inventors: Michael Linley Fripp, Singapore (SG); Wei Zhang, Houston, TX (US); Adan Herrera, Carrollton, TX (US); Aswin Balasubramanian, Spring, TX (US); Sudhir Gupta, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/990,073

(22) Filed: Dec. 20, 2024

(51) Int. Cl.
*E21B 17/03* (2006.01)
*E21B 17/00* (2006.01)

(52) U.S. Cl.
CPC ..... *E21B 17/03* (2013.01); *E21B 17/006* (2013.01)

(58) Field of Classification Search
CPC ..... E21B 17/006; E21B 23/001; E21B 23/14; E21B 23/00; E21B 43/127
See application file for complete search history.

(56) References Cited

U.S. PATENT DOCUMENTS 5,119,344 A * 6/1992 Innes ..... E21B 47/18 367/84
5,586,083 A * 12/1996 Chin ..... E21B 47/18 175/48
9,725,961 B2 8/2017 Skaugset
10,988,991 B1 * 4/2021 McCormick ..... E21B 17/1021
2005/0224233 A1 * 10/2005 Johnson ..... E21B 23/01 166/213
2005/0241819 A1 * 11/2005 Victor ..... E21B 43/121 166/68
2006/0048936 A1 3/2006 Fripp et al.
2012/0048542 A1 * 3/2012 Jacob ..... E21B 17/1021 166/254.2

(Continued)

FOREIGN PATENT DOCUMENTS

CN 205314950 U 6/2016
CN 115637964 A 1/2023

OTHER PUBLICATIONS

De Sousa, et al. "Numerical Analysis of Turbulent Fluid Flow and Drag Coefficient for Optimizing the AUV Hull Design," Open Journal of Fluid Dynamics, vol. 4, No. 3, pp. 263-277, http://dx.doi.org/10.4236/ojfd.2014.43020, Sep. 1, 2014.

(Continued)

*Primary Examiner* — David Carroll
(74) *Attorney, Agent, or Firm* — The Hilton Firm PLLC

(57) ABSTRACT

Mobile downhole tools with fairings and methods of using the same. A mobile downhole tool is introduced into a wellbore. The mobile downhole tool has a housing with a thickness sufficient to support a pressure differential between an interior surface of the housing and an exterior surface of the housing when the mobile downhole tool is disposed in the wellbore, and a fairing coupled to the exterior surface of the housing. The fairing is structurally distinct from the housing and is not connected to the interior surface of the housing. The fairing curves in a first direction that is away from the housing. The mobile downhole tool is propelled in the wellbore as the wellbore is produced such that the mobile downhole tool descends downhole against the upstream flow of a wellbore fluid.

20 Claims, 5 Drawing Sheets

(56) References Cited

U.S. PATENT DOCUMENTS

| | | | | |
|---|---|---|---|---|
| 2013/0299188 | A1* | 11/2013 | Ahmed | E21B 23/14 166/117.6 |
| 2015/0308207 | A1* | 10/2015 | Mccormick | F16N 9/04 104/138.2 |
| 2016/0053554 | A1 | 2/2016 | Skaugset | |
| 2019/0032444 | A1 | 1/2019 | Provost et al. | |
| 2019/0218866 | A1* | 7/2019 | Allen | E21B 17/01 |
| 2020/0340781 | A1* | 10/2020 | Jervis | E21B 23/14 |
| 2021/0371067 | A1 | 12/2021 | Lebo et al. | |

OTHER PUBLICATIONS

International Search Report and Written Opinion mailed Sep. 16, 2025 in PCT/US2025/010427.

* cited by examiner

FAIRINGS FOR MOBILE DOWNHOLE TOOLS IN PRODUCING WELLS

TECHNICAL FIELD

The present disclosure relates generally to mobile downhole tools, and more particularly, to a mobile downhole tool with a nose fairing and a tail fairing for reducing drag in an actively producing wellbore.

BACKGROUND

Mobile downhole tools such as tractors, robots, plugs, and shifters may be introduced into a wellbore to perform a downhole operation. It may be desirable to use a mobile downhole tool in a producing wellbore. The production flow may make descent of the mobile downhole tool difficult as the mobile downhole tool must be propelled against the upward flow of the produced fluids. The use of mobile downhole tools may be an important part of a wellbore operation. The present disclosure provides improved mobile downhole tools with reduced drag and a smaller flow restriction, which may be useful for using the mobile downhole tool in a producing wellbore.

BRIEF DESCRIPTION OF THE DRAWINGS

Illustrative examples of the present disclosure are described in detail below with reference to the attached drawing figures, which are incorporated by reference herein, and wherein.

Figure 1:
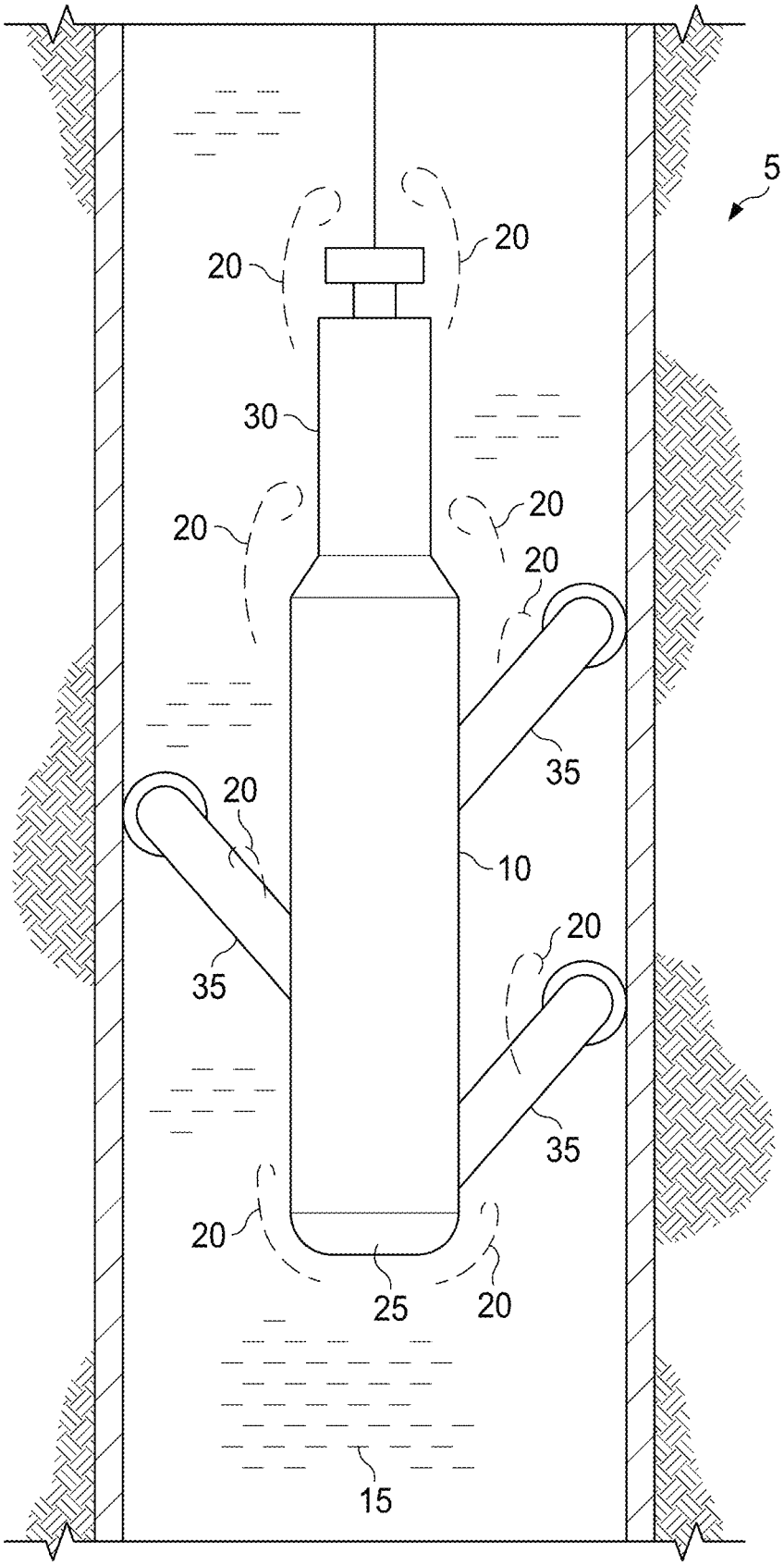
FIG. 1 is a schematic illustrating the resistance experienced by an example mobile downhole tool without fairings in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to mobile downhole tools, and more particularly, to a mobile downhole tool with a nose fairing and a tail fairing for reducing drag in an actively producing wellbore.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present disclosure. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms "uphole" and "downhole" may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The terms "upstream" and "downstream" may be used to refer to the location of various components relative to one another in regards to the flow of a sample through said components. For example, a first component described as upstream from a second component will encounter a sample before the downstream second component encounters the sample. Similarly, a first component described as being downstream from a second component will encounter the sample after the upstream second component encounters the sample.

The present disclosure relates generally to mobile downhole tools, and more particularly, to a mobile downhole tool with a nose fairing and a tail fairing for reducing drag on the mobile downhole tool in an actively producing wellbore. In a producing wellbore, the produced fluids (e.g., hydrocarbons and/or water) may be pumped uphole from a subterranean formation. These fluids may flow to the surface through wellbore conduits such as production tubing. Propelling a mobile downhole tool through this fluid flow requires the downhole tool to overcome the force of the fluid flow as it flows to the surface. Advantageously, the mobile downhole tools disclosed herein comprise fairings to reduce the drag of the production fluid around the mobile downhole tool, thereby allowing the mobile downhole tool to move into this flow. Specifically, the mobile downhole tool comprises a nose fairing and a tail fairing. The nose fairing is a distinct structure from the housing of the mobile downhole tool and faces downhole by curving away from the housing of the mobile downhole tool in the downhole direction. The tail fairing is also a distinct structure from the housing of the mobile downhole tool and faces uphole by curving away from the housing of the mobile downhole tool in the uphole direction. The fairings curve away from the housing of the mobile downhole tool by continuing to narrow in the width of the structure from the point of their attachment to the housing to the terminal end of the fairing. The widest area of each nose fairing and each tail fairing is the location adjacent to the attachment interface of the fairing to the mobile downhole tool. Conversely, the narrowest area of each nose fairing and each tail fairing is the furthest location from the attachment interface of the fairing to the mobile downhole tool, this location is the terminal end of the fairing. This narrowest point of the nose fairing and tail fairing is also the furthest downhole and uphole location respectively of the mobile downhole tool when considering the structure of the mobile downhole tool as a whole. With regards to the nose fairing, the narrowest point of the nose fairing is also the most likely location of the mobile downhole tool to first encounter a fluid residing in the wellbore as the mobile downhole tool descends downhole. The nose fairing and the tail fairing make the mobile downhole tool less sensitive to the flow rate of any flowing produced fluids. The nose fairing and tail fairing are distinct structures from the housing of the mobile downhole tool and do not hold the same pressure differential as the housing of the mobile downhole tool. As a further advantage, additional fairings may also be added to any other structures of the mobile downhole tool such as any wheel arms to reduce drag around these structures and improve the flow of the production fluids around the mobile downhole tool. Examples of the mobile downhole tool may include many different wellbore tools such as tractors, robots, plugs, shifters, and the like. The mobile downhole tool may be autonomous or tethered to surface equipment at the wellsite. Some examples of the mobile downhole tool may comprise motors or other methods of self-propulsion. Other examples may rely entirely on gravity to propel the mobile downhole tool. Advantageously, the fairings may be a variety of curved shapes including conical, ogival, elliptical, polynomial, and the like. As a further advantage, some of the tail fairings may be deformable and configurable to allow a fishing tool to deform the tail fairing before coupling to the mobile downhole tool to retrieve the mobile downhole tool.

The mobile downhole tool may comprise any downhole tool that is moveable within a wellbore, including within wellbore conduits such as production tubing. Specific examples of the mobile downhole tool may include, but are not limited to, tractors, robots, plugs, and shifters. The mobile downhole tool may be coupled to cabling equipment such as wireline or slickline that lower the mobile downhole tool into the wellbore via powered reels or other such surface equipment. In alternative examples, the mobile downhole tool may not be tethered to any cabling and may move autonomously within the wellbore. In still other examples, the mobile downhole tool may comprise motors or other powered propulsion mechanisms to propel itself in the wellbore. Alternatively, the mobile downhole tool may rely solely on gravity to propel itself downhole.

The fairings described herein are structurally distinct from the housing of the mobile downhole tools. The housing of the mobile downhole tools is the body shell that houses the internal components of the mobile downhole tool. The housing is formed of a wall or walls that allow for a pressure differential between the interior surface of the housing and the exterior surface of the housing. The fairings are coupled to the exterior surface of the housing and not the interior surface of the housing. The fairings may be coupled using any sufficient method including welding, threading, bolting, wedging, swaging, pressure fitting, adhesives, and the like. In a specific example, the fairings are threadedly coupled to the housing. The fairings are not supporting structures for the pressure differential of the housing and are not a part of the housing. The fairings are not within the load path of the mobile downhole tool. Specifically, the fairings are not intended to support hydrostatic pressure and the weight of the downhole mobile downhole tool and are not used for such. The fairings do not connect the downhole tool to a possible tether. The fairings are structures added to the exterior of the housing to adjust the drag induced by fluid flow around the housing of the mobile downhole tool. The fairings may be constructed from a material different than the housing, for example, a non-metal.

The fairings are curved structures shaped to reduce drag around areas of the mobile downhole tool. A variety of curved shapes may be used including, but not limited to, conical, ogival, elliptical, polynomial, and the like. Conical shapes utilize straight lines for their sides and may be brought to a sharp or blunted point as desired. In some examples, the conical shaped fairing may comprise a biconic shape. Generally, curved side fairings are preferable to conical shaped fairings; however, conical shaped fairings may be used in some examples A preferred conical shaped fairing has a shallow angle equal to or less than 30 degrees. In one example, the ogival shaped fairing is a tangent ogive shape where the fairing is tangent to the tool body at the base of the fairing. Additional ogival shaped fairings may include, but are not limited to, a blunted tangent ogive, a secant ogive, and the like. An elliptical fairing has the profile of one-half of an ellipse with the major axis being the centerline and the minor axis being the base of the fairing. A polynomial fairing is generated by rotating a segment of a polynomial around a line. A polynomial fairing often produces a fairing with a sharp tip while an elliptical fairing produces a fairing with a blunt tip. In some examples, combinations of shapes may be used. For example, the nose fairing may have an ogival shape while the tail fairing has an elliptical shape. If other fairings are present, such as an arm fairing, these additional fairings may have the same or a different shape than the nose and tail fairings. In addition to the axial shape of the fairings, the fairings may also be shaped radially as desired to provide sufficient drag reduction. For example, the fairings may be radially symmetrical or radially asymmetrical. For example, the radial shape of the arm fairing may be elliptical.

The fluid drag on the fairing has two principal components, the recirculation drag that occurs due to flow separation and the fluid friction drag along the walls of the tool. The nose and tail fairings are designed to reduce the recirculation drag that occurs due to the flow separation that occurs when the fluid encounters the mobile downhole tool.

These fairings may have a smaller effect on the fluid friction drag along the walls of the tool. The value of the drag reduction induced by the fairings may be determined by comparing the ratio of the drag created from flow separation to the total fluid drag resulting from both the flow separation and the fluid friction. The fairings disclosed herein have a ratio of flow separation drag to total fluid drag in a range of about 0.01 to about 0.75. In other words, the fairings will reduce the drag from flow separation so that it is between 1% and 75% of the total fluid drag.

The fairings may be composed of a variety of materials including, but not limited to, aluminum, aluminum alloys, alumina, steel, stainless steel, fiber, fiber composites, polymeric materials, rubber, foam, or any combination of materials. In a specific example, the fairings are composed of an open-cell foam. In some examples, the fairings are hollow shells with ports configured for fluid entry when the mobile downhole tool is disposed in a wellbore. The ports may be positioned in the shell of the fairing at a location which minimizes impact to the drag reduction provided by the fairing. For example, the ports may be placed proximate to where the fairing couples to the housing. The ports may allow wellbore fluids to enter the fairing thereby equalizing the pressure within the fairing interior and the external flowing wellbore fluid. Pressure equalization may reduce the chance of the fairing collapsing. In some alternative examples, the fairings are hollow shells containing at least one material which may include, but is not limited to, a fluid, a gel, a foam, a polymer, or any combination of materials. These specific fairing examples may or may not comprise ports; however, if ports are present, the ports are not open for fluid entry within the wellbore. The hollow shells of these fairings may be filled at the surface with the material prior to introduction to the wellbore.

FIG. 1 is a schematic illustrating the resistance experienced by an example downhole tool 5 without fairings. The mobile downhole tool comprises a housing 10. The housing 10 houses the internal components of the mobile downhole tool 5 and shields these components from wellbore conditions as the mobile downhole tool 5 descends in the wellbore. The housing 10 has a sufficient thickness to support a pressure differential between the external pressure acting on the exterior of the housing 10 and the internal pressure acting on the interior of the housing 10. The housing 10 comprises at least one wall which at least partly defines the area encompassed by the housing 10. In some examples, the housing 10 may comprise multiple layers of walls. In some examples, the wall of the housing 10 may be a continuous structure completely defining the entirety of the housing 10. In alternative examples, the housing may comprise several walls which are shaped and fitted together to create the housing 10. As the mobile downhole tool 5 descends in the wellbore, production fluid 15 flowing uphole contacts the mobile downhole tool 5. As the production fluid 15 contacts the mobile downhole tool 5, the impact of the production fluid 15 on the mobile downhole tool 5 results in separation of the production fluid 15 around the mobile downhole tool 5 creating flow separation drag 20. This flow separation drag 20 occurs at the nose 25, tail 30, and arms 35 of the mobile downhole tool 5. Additional drag is created from the friction of the production fluid 15 as it flows over the surface of the mobile downhole tool 5. The friction and drag from the flow of the production fluid 15 against the mobile downhole tool 5 may impact the ability of the mobile downhole tool 5 to traverse the wellbore as the well is produced.

It should be clearly understood that the example system illustrated by FIG. 1 is merely a general application of the principles of this disclosure in practice, and a wide variety of other examples are possible. Therefore, the scope of this disclosure is not limited in any manner to the details of FIG. 1 as described herein.

Figure 2:
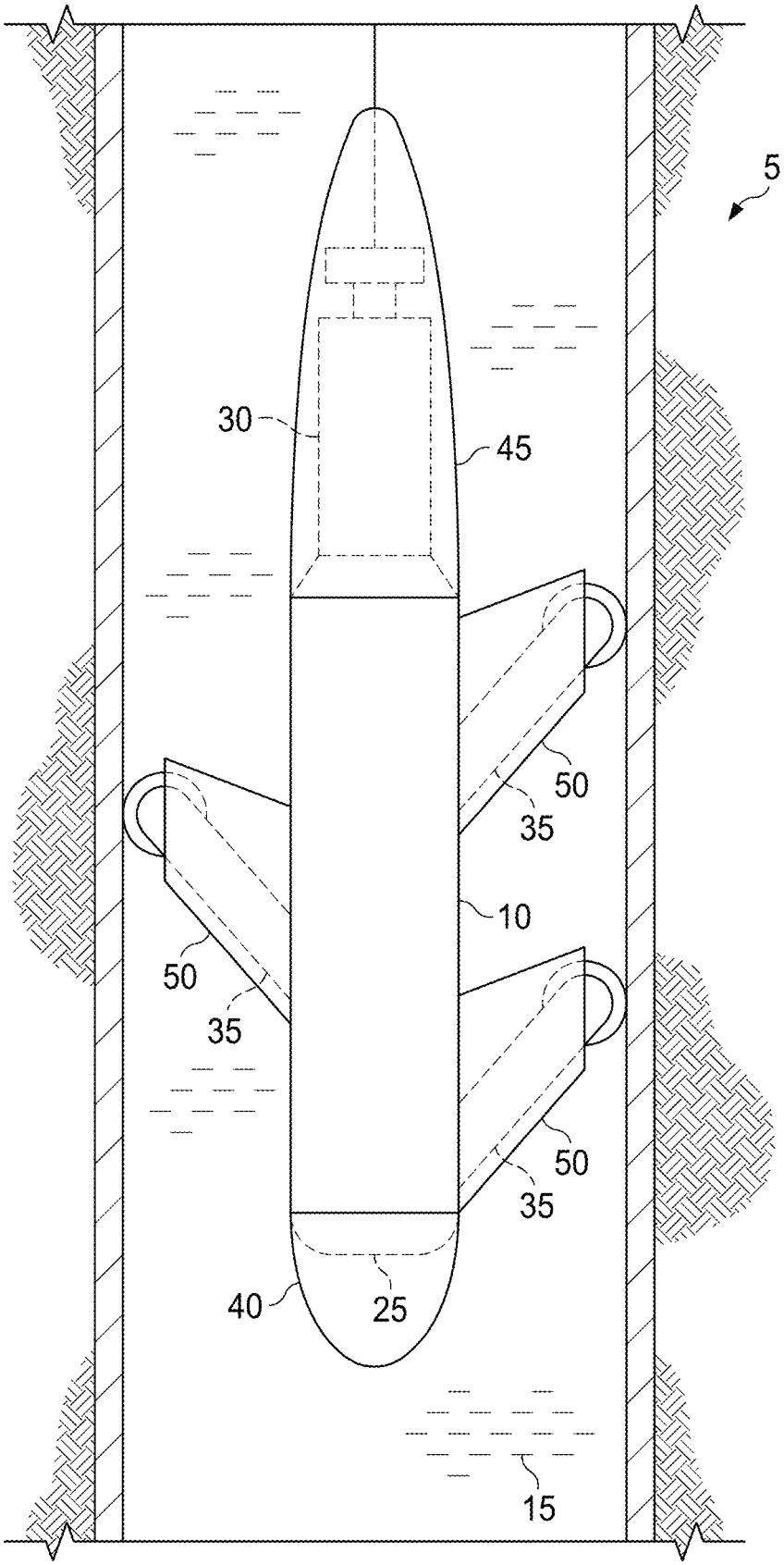
FIG. 2 is a schematic illustrating the resistance experienced by the example mobile downhole tool of FIG. 1 after fairings have been added to the nose, tail, and arms of the mobile downhole tool in accordance with one or more examples described herein.

FIG. 2 is a schematic illustrating the resistance experienced by the example mobile downhole tool 5 of FIG. 1 after fairings have been added to the nose 25, tail 30, and arms 35 of the mobile downhole tool 5. The nose fairing 40 is coupled to the exterior surface of the housing 10 at the location of the nose 25. The tail fairing 45 is coupled to the exterior surface of the housing 10 at the location of the tail 30. The arm fairings 50 are coupled around wheeled arms which are coupled to the exterior surface of the housing 10. The fairings may be coupled using any sufficient method including welding, threading, bolting, wedging, swaging, pressure fitting, adhesives, and the like.

The nose fairing 40, tail fairing 45, and arm fairings 50 are shaped to reduce the fluid separation drag created from the impact of the production fluid 15 against the mobile downhole tool 5 as the production fluid 15 flows uphole in the wellbore or wellbore conduit. The additional surface area of the fairings may increase the amount of fluid friction drag on the mobile downhole device 5, but the large decrease in fluid separation drag offsets this increase and results in a total reduction in drag on the mobile downhole tool 5. The impact of the curved shape of the fairings on overall drag reduction can be measured by determining the ratio of flow separation drag to fluid friction drag. Reducing the flow separation drag relative to fluid friction drag indicates an improvement in overall drag reduction of the mobile downhole tool 5 as the mobile downhole tool 5 moves downhole against flow.

It is to be understood that any of the fairings disclosed herein may be radially symmetric or may be radially asymmetric and the radial symmetry of any of the fairings is independent of the others. For example, a mobile downhole tool having multiple fairings may have some radial symmetric fairings and some radial asymmetric fairings or may have only radially symmetric fairings or only radially asymmetric fairings.

It should be clearly understood that the example system illustrated by FIG. 2 is merely a general application of the principles of this disclosure in practice, and a wide variety of other examples are possible. Therefore, the scope of this disclosure is not limited in any manner to the details of FIG. 2 as described herein.

The mobile downhole tool 5 of FIGS. 1 and 2 is illustrated as a tractor; however, it is to be understood that other mobile downhole tools such as robots, plugs, shifters, and the like may be used analogously with the fairings described herein. Additionally, the mobile downhole tool 5 is illustrated as being lowered into a wellbore conduit via a wireline coupled to the tail 30 of the mobile downhole device 5. In some examples, the mobile downhole tool 5 may autonomously descend downhole without being tethered to the surface. The mobile downhole tool 5 may use motorized propulsion, gravity, or other means to descend in the wellbore, with or without tethering of the mobile downhole tool 5 to surface or uphole equipment.

Figure 3B:
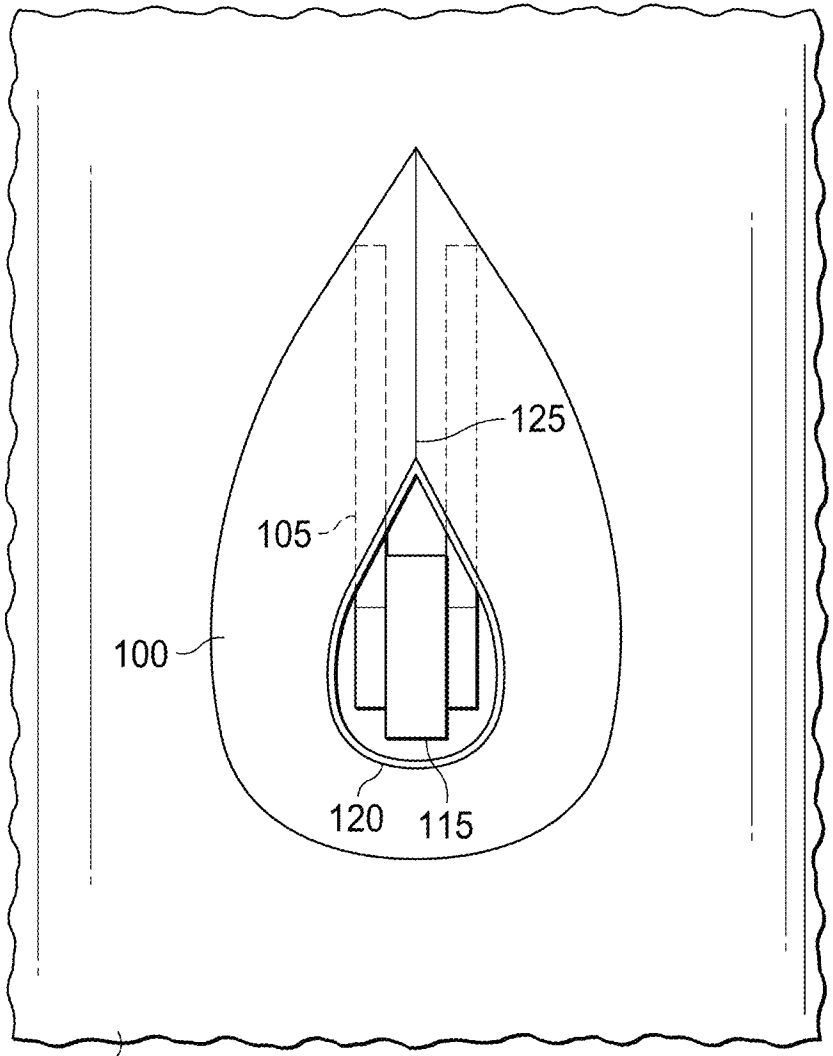
FIG. 3B is a vertical perspective of an arm fairing disposed around an arm coupled to the exterior surface of a housing in accordance with one or more examples described herein.
Figure 3A:
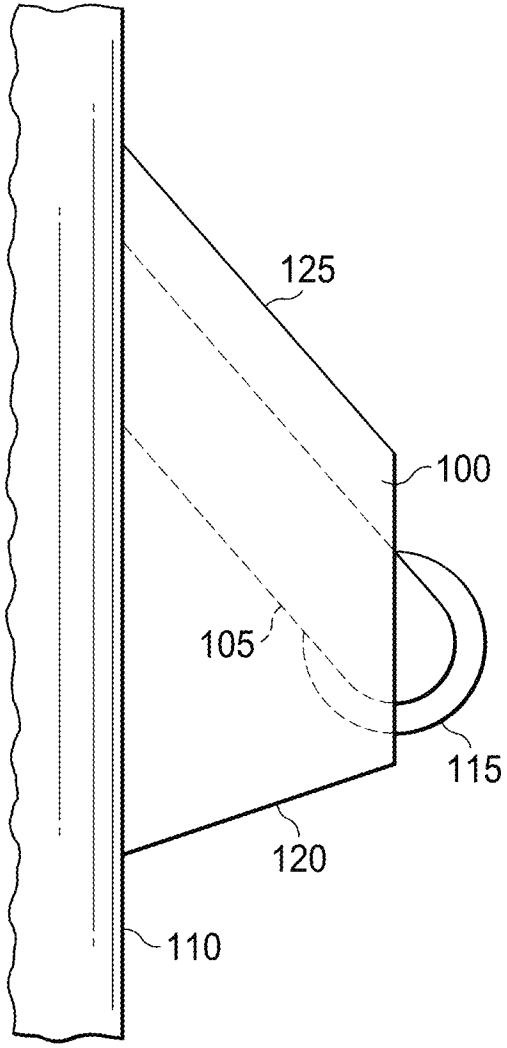
FIG. 3A is a side perspective of an arm fairing disposed around an arm coupled to the exterior surface of a housing in accordance with one or more examples described herein.

FIG. 3A is a side perspective and FIG. 3B is a vertical perspective of an arm fairing 100 disposed around an arm 105 coupled to the exterior surface of the housing 110. The arm fairing 100 is opened at the end of the arm 105 comprising the wheel 115. The opening allows the wheel 115 to extend past the terminal end of the arm fairing 100 so that it may contact an adjacent surface. In this specific example, the arm fairing 100 comprises an elliptical shape towards the downhole end 120 and a conical shape at the uphole end 125. The overall shape of the arm fairing 100 resembles a teardrop design. It is to be understood that different shapes for the fairing may be used as disclosed herein. The arm fairing 100 may be coupled to the arm 105 and/or the exterior surface of the housing 110 using any sufficient method including welding, threading, bolting, wedging, swaging, pressure fitting, adhesives, and the like. The fairing on the arm 110 is radially asymmetric but may be symmetric in some alternative examples.

It should be clearly understood that the example system illustrated by FIGS. 3A and 3B are merely a general application of the principles of this disclosure in practice, and a wide variety of other examples are possible. Therefore, the scope of this disclosure is not limited in any manner to the details of FIGS. 3A and 3B as described herein.

Figure 4:
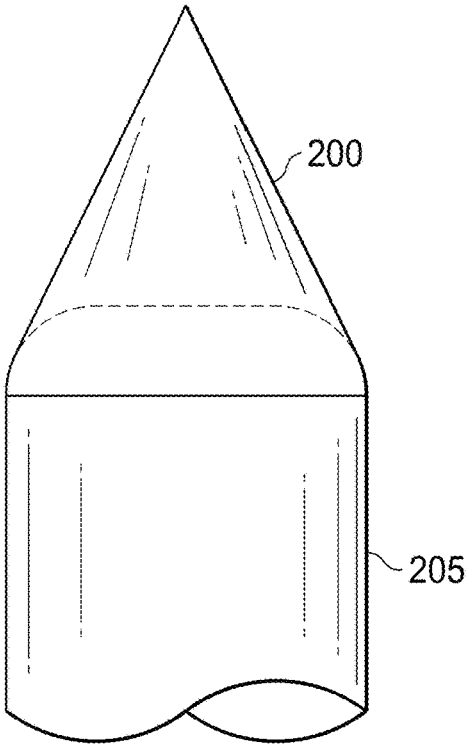
FIG. 4 is a side perspective of an example fairing having a conical shape in accordance with one or more examples described herein.

FIG. 4 is a side perspective of an example fairing 200 having a conical shape. The fairing 200 may be affixed to the mobile downhole tool using any sufficient method. In the illustrated example, the fairing 200 is affixed to the nose 205 of the mobile downhole tool. In other examples, the conical shaped fairing 200 may be affixed to other portions of the downhole tool including the tail, arms, etc.

Figure 5:
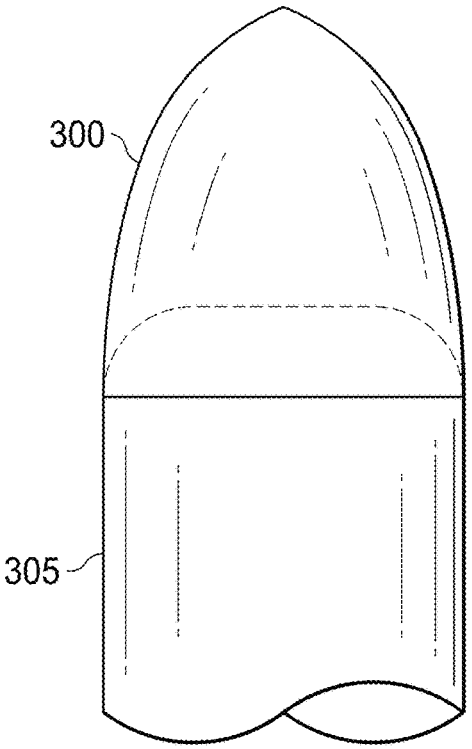
FIG. 5 is a side perspective of an example fairing having an ogival shape in accordance with one or more examples described herein.

FIG. 5 is a side perspective of an example fairing 300 having an ogival shape. The fairing 300 may be affixed to the mobile downhole tool using any sufficient method. In the illustrated example, the fairing 300 is affixed to the nose 305 of the mobile downhole tool. In other examples, the ogival shaped fairing 300 may be affixed to other portions of the downhole tool including the tail, arms, etc.

Figure 6:
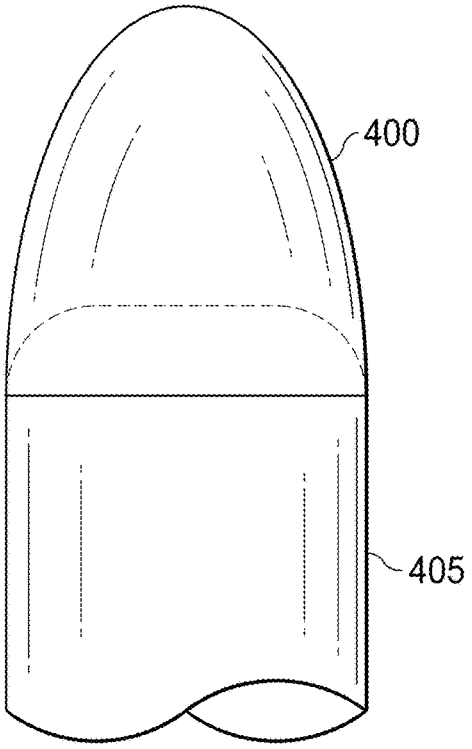
FIG. 6 is a side perspective of an example fairing having an elliptical shape in accordance with one or more examples described herein.

FIG. 6 is a side perspective of an example fairing 400 having an elliptical shape. The fairing 400 may be affixed to the mobile downhole tool using any sufficient method. In the illustrated example, the fairing 400 is affixed to the nose 405 of the mobile downhole tool. In other examples, the elliptical shaped fairing 400 may be affixed to other portions of the downhole tool including the tail, arms, etc.

It should be clearly understood that the example systems illustrated by FIGS. 4-6 are merely a general application of the principles of this disclosure in practice, and a wide variety of other examples are possible. Therefore, the scope of this disclosure is not limited in any manner to the details of FIGS. 4-6 as described herein.

Figure 7:
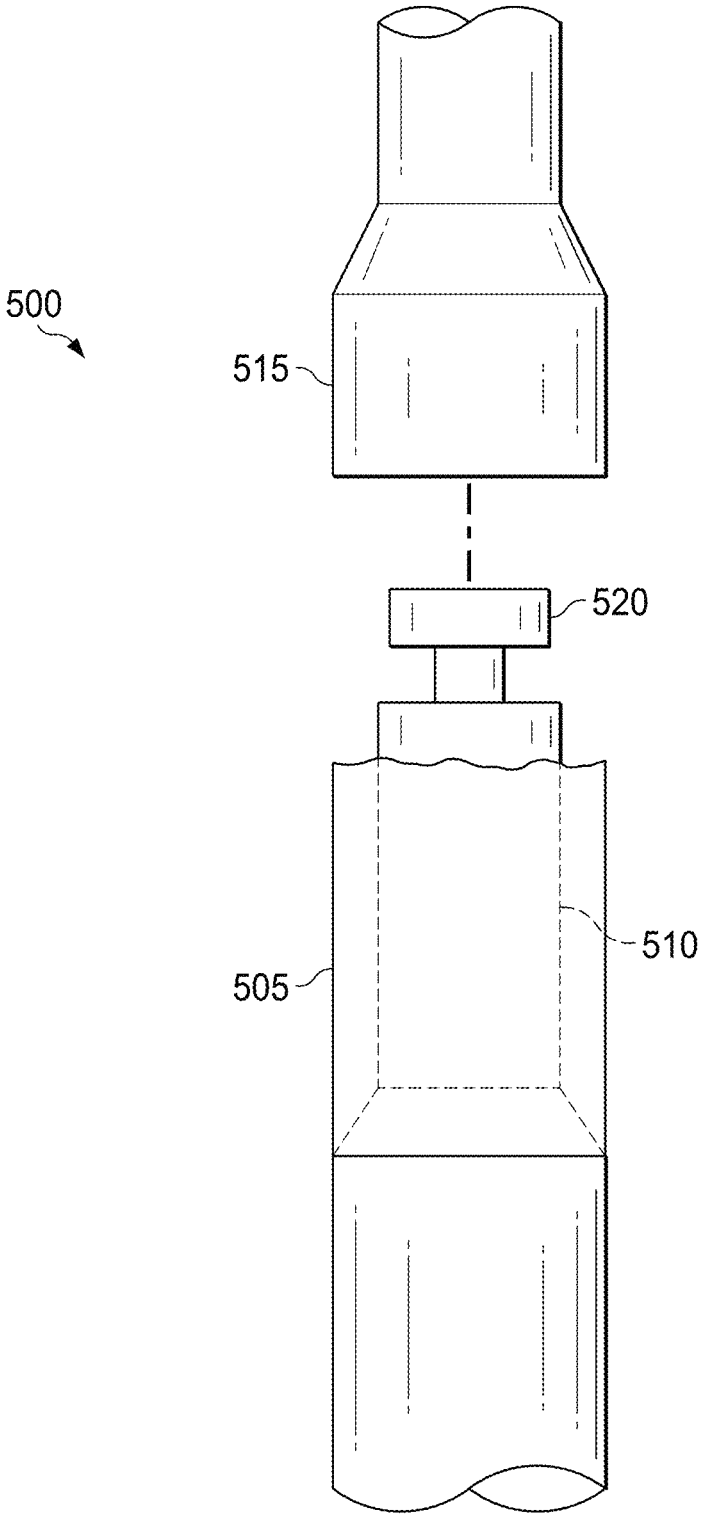
FIG. 7 is a schematic illustrating a mobile downhole tool in the process of being fished from a wellbore in accordance with one or more examples described herein.

FIG. 7 is a schematic illustrating a mobile downhole tool 500 in the process of being fished from a wellbore. In the illustrated examples, a tail fairing 505 was disposed over the tail 510 of the mobile downhole tool 500. In this specific example, the tail fairing 505 was composed of a deformable material. A fishing tool 515 was lowered into the wellbore where it has contacted and sufficiently deformed the tail fairing 505. This deformation allows the fishing tool 515 to access a coupling point 520 on the tail 510 of the mobile downhole tool 500. The tail fairing 505 may be deformed by being frangible, crushable, bendable, or the like. Examples of the deformable material may include, but are not limited to, certain metals such as aluminum, aluminum alloys, certain grades/types of steel such as annealed steel, fibrous materials, fibrous composites, polymeric materials, elastomeric materials such as rubbers, foams such as open cell thermoplastic foam, glass, crushable ceramic like alumina, and any combination of materials. In a specific example, the tail fairing 505 is constructed from a thin-walled metal that is deformed and then broken/crushed by the fishing tool 515 to allow the fishing tool 515 to couple to the coupling point 520. Once the fishing tool 515 couples to the coupling point 520, the mobile downhole tool 500 may be retrieved uphole, including to the surface of the wellsite.

It should be clearly understood that the example system illustrated by FIG. 7 is merely a general application of the principles of this disclosure in practice, and a wide variety of other examples are possible. Therefore, the scope of this disclosure is not limited in any manner to the details of FIG. 7 as described herein.

Provided are mobile downhole tools in accordance with the disclosure and the illustrated FIGs. An example mobile downhole tool comprises a housing having a thickness sufficient to support a pressure differential between an interior surface of the housing and an exterior surface of the housing when the mobile downhole tool is disposed in a wellbore, and a fairing coupled to the exterior surface of the housing. The fairing is structurally distinct from the housing and is not connected to the interior surface of the housing. The fairing curves in a first direction that is away from the housing.

Additionally or alternatively, the mobile downhole tool may include one or more of the following features individually or in combination. The fairing may be a nose fairing that faces downhole when the mobile downhole tool is disposed in the wellbore. The fairing may be a tail fairing that faces uphole when the mobile downhole tool is disposed in the wellbore. The mobile downhole tool may further comprise an arm extending from the exterior surface of the housing. The arm may comprise a terminal end coupled to a wheel. The mobile downhole tool may further comprise an arm fairing surrounding the arm. The fairing may comprise a material selected from the group consisting of aluminum, aluminum alloys, alumina, steel, stainless steel, fiber, fiber composites, polymeric materials, rubber, foam, and any combination thereof. The faring may be a hollow shell with ports configured for fluid entry when the mobile downhole tool is disposed in the wellbore. The fairing may be a hollow shell containing a material selected from the group consisting of a fluid, gel, foam, polymer, and any combination thereof. The mobile downhole tool may be a tractor, robot, plug, or a shifter. The mobile downhole tool may be coupled to a wireline or a slickline. The curve of the fairing may be conical, ogival, elliptical, or polynomial shape. The curve of the fairing may have a ratio of flow separation drag to fluid friction drag in a range of about 0.01 to about 0.75. When the fairing is a tail fairing, the tail fairing may comprise a deformable material and the deformable material may deform to reveal a coupling point configurable for fishing the mobile downhole tool from the wellbore.

Provided are methods for propelling a mobile downhole tool in a wellbore in accordance with the disclosure and the illustrated FIGs. An example method comprises introducing a mobile downhole tool into the wellbore. The mobile downhole tool comprises a housing with a thickness sufficient to support a pressure differential between an interior surface of the housing and an exterior surface of the housing when the mobile downhole tool is disposed in the wellbore, and a fairing coupled to the exterior surface of the housing. The fairing is structurally distinct from the housing and is not connected to the interior surface of the housing. The fairing curves in a first direction that is away from the housing. The method further comprises propelling the mobile downhole tool in the wellbore as the wellbore is produced such that the mobile downhole tool descends downhole against the upstream flow of a wellbore fluid.

Additionally or alternatively, the method may include one or more of the following features individually or in combination. The fairing may be a tail fairing and the method may further comprise fishing the mobile downhole tool from the wellbore by deforming the tail fairing with a fishing tool to reveal a coupling point, coupling the fishing tool to the coupling point, and retrieving the mobile downhole tool with the fishing tool. The fairing may be a nose fairing that faces downhole when the mobile downhole tool is disposed in the wellbore. The fairing may be a tail fairing that faces uphole when the mobile downhole tool is disposed in the wellbore. The mobile downhole tool may further comprise an arm extending from the exterior surface of the housing. The arm may comprise a terminal end coupled to a wheel. The mobile downhole tool may further comprise an arm fairing surrounding the arm. The fairing may comprise a material selected from the group consisting of aluminum, aluminum alloys, alumina, steel, stainless steel, fiber, fiber composites, polymeric materials, rubber, foam, and any combination thereof. The faring may be a hollow shell with ports configured for fluid entry when the mobile downhole tool is disposed in the wellbore. The fairing may be a hollow shell containing a material selected from the group consisting of a fluid, gel, foam, polymer, and any combination thereof. The mobile downhole tool may be a tractor, robot, plug, or a shifter. The mobile downhole tool may be coupled to a wireline or a slickline. The curve of the fairing may be conical, ogival, elliptical, or polynomial shape. The curve of the fairing may have a ratio of flow separation drag to fluid friction drag in a range of about 0.01 to about 0.75. When the fairing is a tail fairing, the tail fairing may comprise a deformable material and the deformable material may deform to reveal a coupling point configurable for fishing the mobile downhole tool from the wellbore.

Provided are systems for propelling a mobile downhole tool in a wellbore in accordance with the disclosure and the illustrated FIGs. An example system comprises a mobile downhole tool and a conveyance tethering the mobile downhole tool to a surface of a wellsite. The mobile downhole tool comprises a housing with a thickness sufficient to support a pressure differential between an interior surface of the housing and an exterior surface of the housing when the mobile downhole tool is disposed in the wellbore, and a fairing coupled to the exterior surface of the housing. The fairing is structurally distinct from the housing and is not connected to the interior surface of the housing. The fairing curves in a first direction that is away from the housing.

Additionally or alternatively, the systems may include one or more of the following features individually or in combination. The conveyance may be a slickline or a wireline. The fairing may be a nose fairing that faces downhole when the mobile downhole tool is disposed in the wellbore. The fairing may be a tail fairing that faces uphole when the mobile downhole tool is disposed in the wellbore. The mobile downhole tool may further comprise an arm extending from the exterior surface of the housing. The arm may comprise a terminal end coupled to a wheel. The mobile downhole tool may further comprise an arm fairing surrounding the arm. The fairing may comprise a material selected from the group consisting of aluminum, aluminum alloys, alumina, steel, stainless steel, fiber, fiber composites, polymeric materials, rubber, foam, and any combination thereof. The faring may be a hollow shell with ports configured for fluid entry when the mobile downhole tool is disposed in the wellbore. The fairing may be a hollow shell containing a material selected from the group consisting of a fluid, gel, foam, polymer, and any combination thereof. The mobile downhole tool may be a tractor, robot, plug, or a shifter. The mobile downhole tool may be coupled to a wireline or a slickline. The curve of the fairing may be conical, ogival, elliptical, or polynomial shape. The curve of the fairing may have a ratio of flow separation drag to fluid friction drag in a range of about 0.01 to about 0.75. When the fairing is a tail fairing, the tail fairing may comprise a deformable material and the deformable material may deform to reveal a coupling point configurable for fishing the mobile downhole tool from the wellbore.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A mobile downhole tool comprising:

a housing having a thickness sufficient to support a pressure differential between an interior surface of the housing and an exterior surface of the housing when the mobile downhole tool is disposed in a wellbore, and a fairing coupled to the exterior surface of the housing; wherein the fairing is structurally distinct from the housing and is not connected to the interior surface of the housing; wherein the fairing curves in a first direction that is away from the housing;

wherein the mobile downhole tool is coupled to a wireline or a slickline.

2. The mobile downhole tool of claim 1, wherein the fairing is a nose fairing, wherein the nose fairing faces downhole when the mobile downhole tool is disposed in the wellbore.

3. The mobile downhole tool of claim 1, wherein the fairing is a tail fairing wherein the tail fairing faces uphole when the mobile downhole tool is disposed in the wellbore.

4. The mobile downhole tool of claim 1, further comprising an arm extending from the exterior surface of the housing; wherein the arm comprises a terminal end coupled to a wheel; wherein the mobile downhole tool further comprises an arm fairing surrounding the arm.

5. The mobile downhole tool of claim 1, wherein the fairing comprises a material selected from the group consisting of aluminum, aluminum alloys, alumina, steel, stainless steel, fiber, fiber composites, polymeric materials, rubber, foam, and any combination thereof.

6. The mobile downhole tool of claim 1, wherein the faring is a hollow shell with ports configured for fluid entry when the mobile downhole tool is disposed in the wellbore.

7. The mobile downhole tool of claim 1, wherein the fairing is a hollow shell containing a material selected from the group consisting of a fluid, gel, foam, polymer, and any combination thereof.

8. The mobile downhole tool of claim 1, wherein the mobile downhole tool is a tractor, robot, plug, or a shifter.

9. The mobile downhole tool of claim 1, wherein the curve of the fairing is conical, ogival, elliptical, or polynomial shape.

10. The mobile downhole tool of claim 1, wherein the fairing is a tail fairing comprising a deformable material that deforms to reveal a coupling point configurable for fishing the mobile downhole tool from the wellbore.

11. A method for propelling a mobile downhole tool in a wellbore, the method comprises:

introducing a mobile downhole tool into the wellbore; wherein the mobile downhole tool comprises:

a housing with a thickness sufficient to support a pressure differential between an interior surface of the housing and an exterior surface of the housing when the mobile downhole tool is disposed in the wellbore, and a fairing coupled to the exterior surface of the housing; wherein the fairing is structurally distinct from the housing and is not connected to the interior surface of the housing; wherein the fairing curves in a first direction that is away from the housing, wherein the mobile downhole tool is coupled to a wireline or a slickline; and propelling the mobile downhole tool in the wellbore as the wellbore is produced such that the mobile downhole tool descends downhole against the upstream flow of a wellbore fluid.

12. The method of claim 11, wherein the fairing is a tail fairing; wherein the method further comprises fishing the mobile downhole tool from the wellbore by deforming the tail fairing with a fishing tool to reveal a coupling point, coupling the fishing tool to the coupling point, and retrieving the mobile downhole tool with the fishing tool.

13. The method of claim 11, wherein the mobile downhole tool is a tractor, robot, plug, or a shifter.

14. The method of claim 11, wherein the curve of the fairing is conical, ogival, elliptical, or polynomial shape.

15. A system for propelling a mobile downhole tool in a wellbore, the system comprises:

a mobile downhole tool comprising:

a housing with a thickness sufficient to support a pressure differential between an interior surface of the housing and an exterior surface of the housing when the mobile downhole tool is disposed in the wellbore, and a fairing coupled to the exterior surface of the housing; wherein the fairing is structurally distinct from the housing and is not connected to the interior surface of the housing; wherein the fairing curves in a first direction that is away from the housing, and a conveyance tethering the mobile downhole tool to a surface of a wellsite; wherein the conveyance is a slickline or a wireline.

16. The system of claim 15, wherein the mobile downhole tool is a tractor, robot, plug, or a shifter.

17. The system of claim 15, wherein the fairing is a nose fairing; wherein the nose fairing faces downhole when the mobile downhole tool is disposed in the wellbore.

18. The system of claim 15, wherein the fairing is a tail fairing wherein the tail fairing faces uphole when the mobile downhole tool is disposed in the wellbore.

19. The system of claim 15, further comprising an arm extending from the exterior surface of the housing; wherein the arm comprises a terminal end coupled to a wheel; wherein the mobile downhole tool further comprises an arm fairing surrounding the arm.

20. The system of claim 15, wherein the fairing is a tail fairing comprising a deformable material that deforms to reveal a coupling point configurable for fishing the mobile downhole tool from the wellbore.

* * * * *